United States Patent [19]

Starkey

[11] Patent Number: 4,466,141

[45] Date of Patent: Aug. 21, 1984

[54] HYDROTHERMAL TREATMENT FACILITY

[76] Inventor: Walter D. Starkey, 6504 S. Waco, Tulsa, Okla. 74132

[21] Appl. No.: 397,156

[22] Filed: Jul. 12, 1982

[51] Int. Cl.[3] ..... E04H 3/18; E03C 1/02; A61H 33/02

[52] U.S. Cl. ..... 4/488; 4/492; 4/541; 4/542; 128/66

[58] Field of Search ..... 4/541, 542, 492, 488, 4/506; 128/66

[56] References Cited

U.S. PATENT DOCUMENTS

| | | | |
|---|---|---|---|
| D. 251,201 | 2/1979 | Mathis | 4/488 X |
| D. 254,447 | 3/1980 | Reineman | 4/488 X |
| D. 254,572 | 3/1980 | Reineman | 4/488 X |
| 3,693,194 | 9/1972 | Schindler et al. | 4/492 |
| 4,142,337 | 3/1979 | Holcomb | 4/492 X |
| 4,149,281 | 4/1979 | Bob et al. | 4/542 X |
| 4,233,694 | 11/1980 | Janosko et al. | 4/542 |
| 4,238,859 | 12/1980 | Badon, Jr. | 4/492 X |
| 4,340,982 | 7/1982 | Hart et al. | 4/541 |

*Primary Examiner*—Henry K. Artis

*Attorney, Agent, or Firm*—Head, Johnson & Stevenson

[57] ABSTRACT

A hydrothermal treatment facility is in the form of a vessel for containing heated water, the vessel sidewalls being contoured to receive and support arthritic users in a plurality of positions, at least one portion being configured to receive a user in a seated position with the user's feet on the vessel floor, at least one portion of the vessel being configured to support a user in a semi-reclined position with the user's head being supported and at least one foot on the vessel floor and at least one portion of the vessel being configured to support a user in a reclined position with the user's legs and feet being supported above the vessel floor, and a plurality of jets by which water is injected into the interior of the vessel, the jets being positioned so that water flowing therethrough impinges on the joints of the users.

3 Claims, 5 Drawing Figures

HYDROTHERMAL TREATMENT FACILITY

Summary of the Invention

This invention provides an enclosure for hydrothermal treatment for users needing the therapeutic benefits of whirlpool type conditions particularly applied to the joint areas. In the preferred arrangement of the invention a vessel is provided for containing heated water and arranged to accommodate a maximum of six users or any lesser number of users with the contour of the vessel arranged such that users may employ the treatment facilities for best advantages to certain joint areas. The vessel is preferably recessed below a floor area although it can be configured so as to have sidewalls raised above a floor surface on which it is positioned. Steps are formed in one wall of the vessel extending from the vessel upper edge to the vessel floor so that users may enter downwardly into the vessel. The vessel sidewalls are contoured to receive and support users in a plurality of positions, at least one portion being configured to receive a user in a seated position with the user's feet on the vessel floor and with the user sitting more or less uprightly with his head unsupported. In a preferred arrangement two such upright seating areas are provided.

Other portions of the vessel are provided to support the user in a semi-reclined position so that the user's back and head are supported but wherein the lower legs extend down to engage the floor. In the semi-seated arrangement the vessel sidewalls preferably provide a ledge so that one leg of the user may be extended generally horizontally while the other leg extends downwardly. In the preferred arrangement two such semi-reclined seating areas are provided in which in one seating area the left leg of the user is supported in a horizontal manner; and in the other seating area, the right leg of the user is supported in a horizontal manner. Each of these semi-reclined seating areas includes means for supporting at least one of the arms of the user also in a horizontal manner.

The vessel sidewalls in the preferred arrangement include at least one area supporting a user in a reclined position wherein both legs of the user are supported horizontally and the head of the user is supported. In the preferred arrangement two such areas are provided, and the sidewall includes ledges supporting, in one of the fully reclined areas, the left arm of the user in a horizontal manner; and in the other reclined area, the right arm of the user is supported in a horizontal manner.

The vessel is provided with a large number of jets to receive the inflow of warm water or a mixture of warm water and air. The jets are arranged to impinge upon the joint areas of the users such as the areas of the back of the neck, the spine, hips, knees, ankles, shoulders, elbows and wrists.

DETAILED DESCRIPTION

Figure 2:
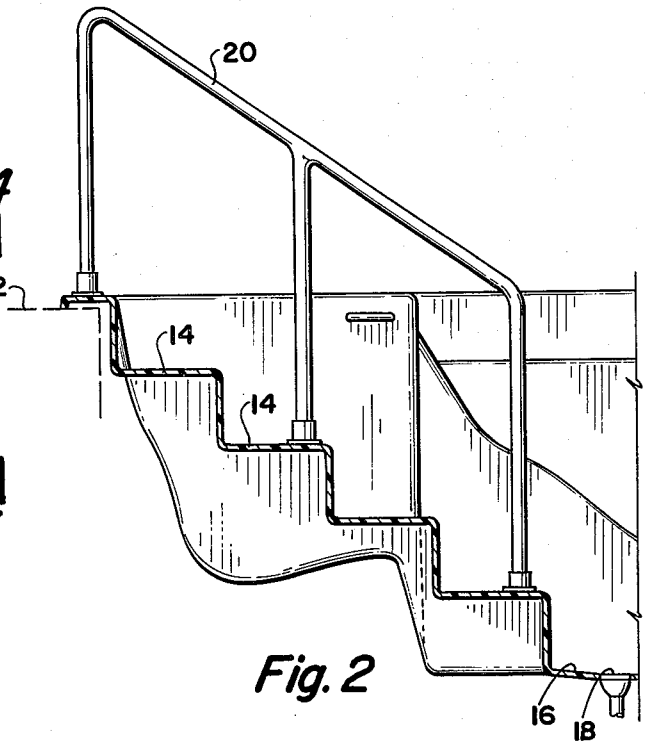
FIG. 2 is a cross-sectional view taken along the line 2—2 of FIG. 1 showing the arrangement of the steps and handrail for the entry of users into the vessel.
Figure 1:
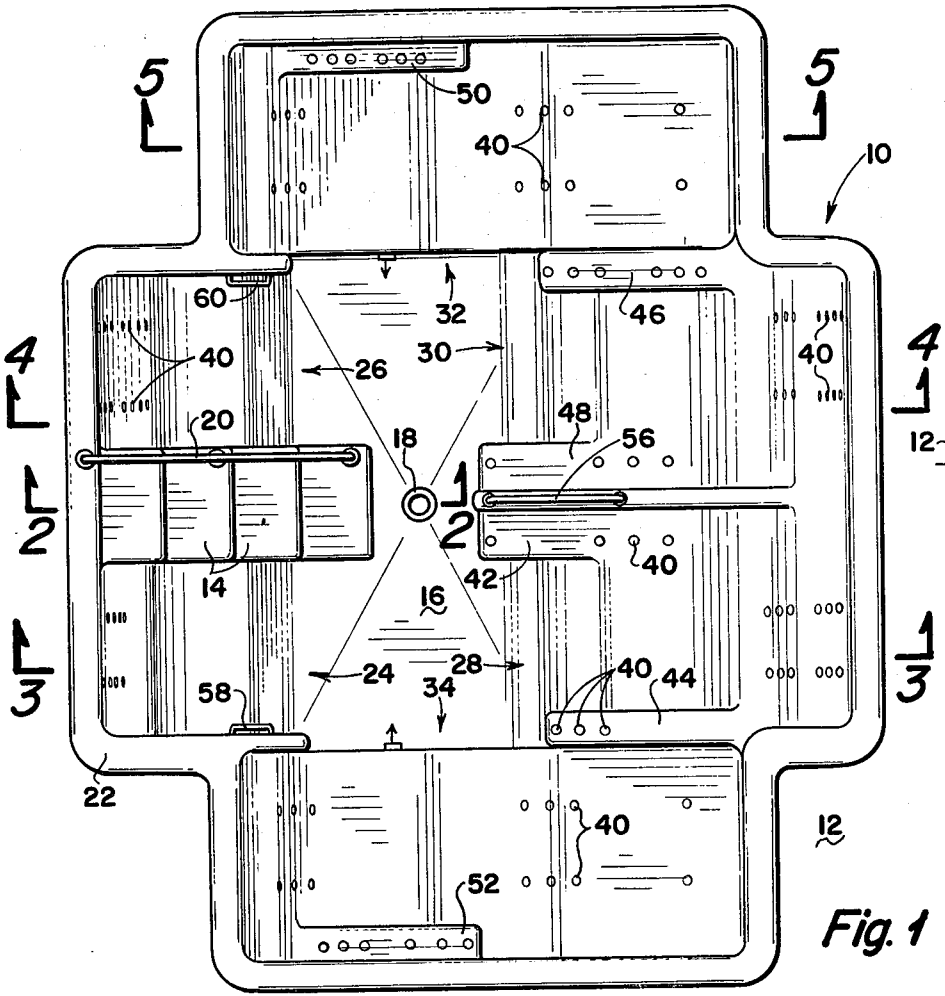
FIG. 1 is a plan view of the preferred embodiment of the invention showing a vessel designed for being recessed in a floor. The vessel is particularly designed for six users in which two users are supported in seated position, two are supported in a semi-reclined position, and two are supported in a fully reclined position. Steps are provided for the entry of the users into the interior of the vessel.

Referring to the drawings and first to FIG. 1, the plan view of a preferred embodiment of the invention is shown. The invention is in the form of a vessel for users who will benefit from hydrothermal treatment. The preferred arrangement includes a vessel 10 which is recessed below the floor level although it can be seen that the vessel may be formed of high exterior sidewalls for positioning on a floor. When formed of exterior sidewalls it will be necessary that an external ladder or other means be provided for users to move up and over the sidewalls. In the illustrated arrangement wherein the vessel is recessed below level of floor 12 the interior sidewalls of the vessel, as shown best in FIGS. 1 and 2, include steps 14 by which the user can enter into the vessel onto the vessel floor 16. A drain 18 is provided in the vessel floor by which water in the vessel may be emptied.

A hand rail 20 is secured to the upper circumferential ledge 22 and steps 14 to aid the user in entering and leaving 20 the vessel.

The internal sidewalls of the vessel are arranged to support users in a variety of positions. Specifically, in the arrangement of FIG. 1, the vessel provides means to accommodate six users, two in a seated position, two in a semi-reclined position, and two in a fully reclined position. In addition to supporting the users in the variety of positions, the vessel includes means of supporting the arms and legs of users of the semi-reclined portions of the vessel in horizontal position.

Portions of the vessel sidewalls contoured to receive users in seated positions are generally indicated by the numerals 24 and 26; the portions of the vessel contoured to receive users in semi-reclined positions are generally indicated by the numerals 28 and 30; and the portions of the vessel contoured to receive users in fully reclined positions are indicated by the numerals 32 and 34.

Figure 3:
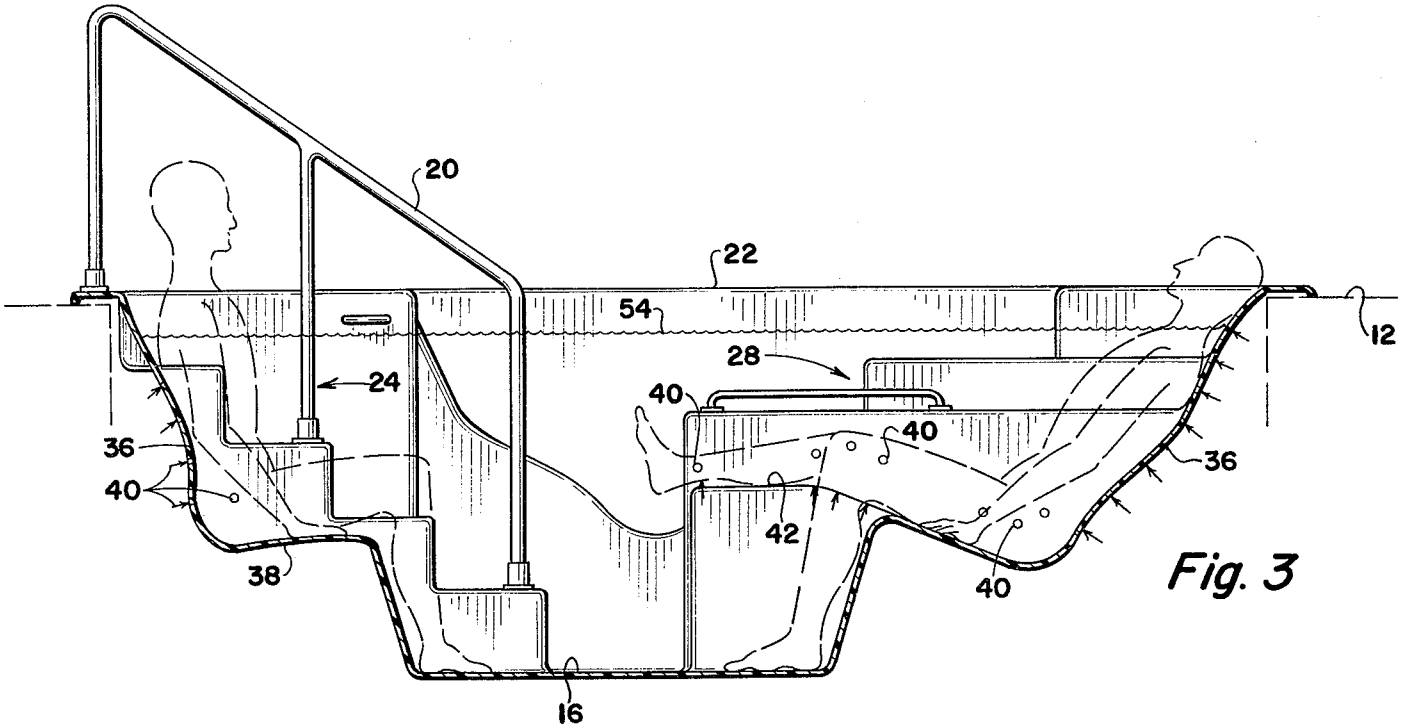
FIG. 3 is a cross-sectional view taken along the line 3—3 of FIG. 2 showing two of the areas for receiving users, one in a seated position and the other in a semi-reclined position in which the right leg of the user is supported in a horizontal position.

Referring to FIG. 3, the areas 24 and 28 are shown in cross-section. The area 24 shows the vessel sidewall 36 contoured to receive the user in an upright position providing a seat area 38. The feet of the user rest on the floor 16, and the head of the user is unsupported.

The vessel includes a plurality of openings for jets, the openings being indicated by the numeral 40 although only a few of the jet openings are numbered for purposes of illustration. The jets 40 are arranged to impinge on the joints of the user such as the back and the hip. Thus the areas 24 and 26 will primarily be utilized by users wishing special treatment to the back and hip areas.

The right-hand portion of FIG. 3 shows, in dotted outline, a user in semi-reclined position 28. The sidewall 36 is contoured to support the back and head of the user. In position 28 the user may place both feet on the floor 16, or the sidewall includes a horizontal ledge for the right leg of the user. The position 28 also includes, although not shown in FIG. 3 but shown in FIG. 1, a horizontal ledge 44 for the left arm of the user. The jets 40 are arranged to impinge on the back of the neck of the user, along his spine, hips, and knees. In addition, a jet is provided to impinge on the ankle portion of the leg supported on ledge 42; and, as shown in FIG. 1, jets 40 extending from the arm ledge 44 are arranged to impinge upon the elbow, wrist and hand of the arm supported on the ledge.

Figure 4:
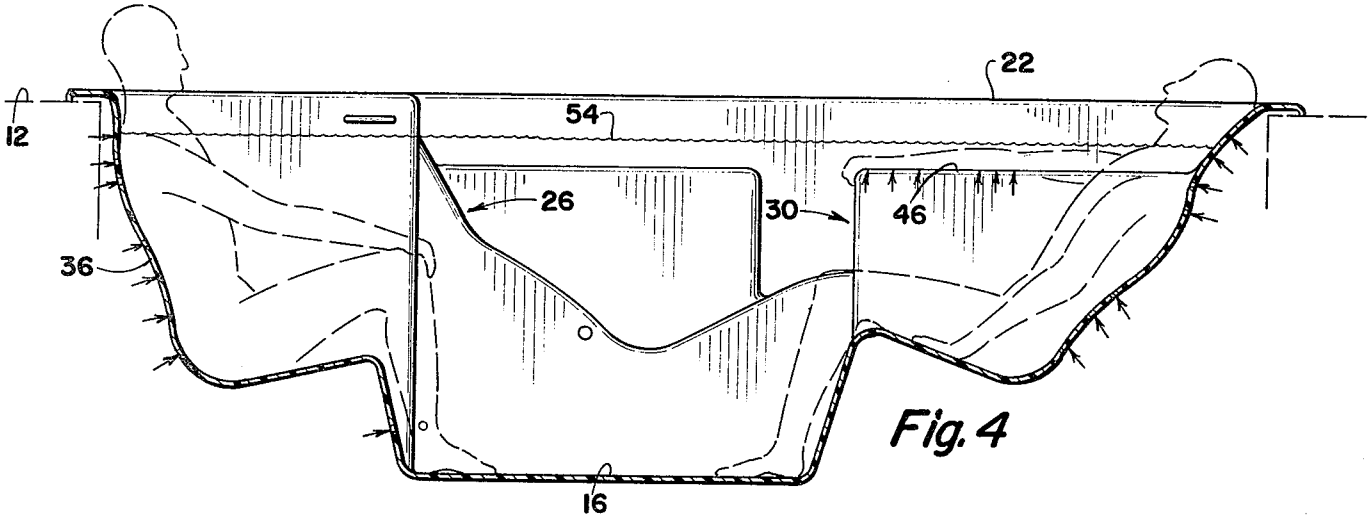
FIG. 4 is a cross-sectional view taken along the line 4—4 of FIG. 1 and showing more details of the seating arrangement.

FIG. 4 shows in cross-sections the positions 26 and 30 which are similar to the positions 24 and 28 described. The primary difference is that position 30 provides a ledge 46 for the right arm of the user seated in the semi-reclined area 30. In addition, although not shown in FIG. 4 but shown in FIG. 1, the position 30 includes a horizontal ledge for the left leg of the user with jets 40 properly positioned to impinge on the joints of the users.

Figure 5:
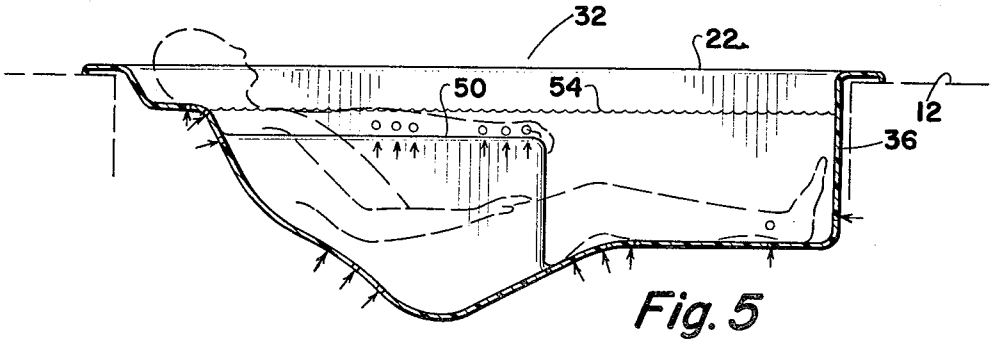
FIG. 5 is a cross-sectional view taken along the line 5—5 of FIG. 1 showing the seating arrangement of one of the areas for supporting a user in a fully reclined position with the legs supported generally horizontally and the head of the user being supported. In the area shown in FIG. 5 the left arm of the user is supported in a horizontal manner.

FIG. 5 is a cross-sectional view of the area 32 which supports a user in a fully reclined position with both legs supported generally horizontally and with the head of the user being supported. In position 32 a ledge 50 supports the left arm of the user. Position 34 is not shown in cross-sectional arrangement but is substantially identical to that of FIG. 5 except that a ledge 52 supports the right arm of the user as shown in FIG. 1.

The water level in the vessel as shown in FIGS. 3, 4, and 5 is selected such that the users in the semi-reclined and fully reclined position are completely submerged in water except for their heads. As previously indicated, the jets 40 can be arranged as many as desired to fully impinge on all affected joints of users.

In addition to the provision of handrail 20 for assisting users on steps 14, handrails 56, 58 may also be provided as security for users moving in and about in the vessel.

The vessel makes available a variety of opportunities for users. While six users may employ the vessel at one time, it can be seen that any lesser number may make even better use of the facility by moving from one position to another so that all joints of the body are then subjected to the jet action of water or of water mixed with air for the beneficial effect it provides.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed is:

1. An enclosure for hydrothermal treatment of users comprising:

a vessel for containing heated water, the vessel having a floor and sidewalls and an upper circumferential ledge, the vessel being of depth so that the water level above the floor is about waist deep for the average user;

steps formed in a portion of one wall of said vessel extending from said upper ledge to said vessel floor whereby users may enter downwardly into said vessel;

the vessel being contoured to receive and support one or more users, including:

(a) a first portion having a lower surface raised about chair height above said floor and contoured in a generally horizontal plane to receive a user in a reclined position with both legs extended parallel and generally horizontally and with the user's back supported in an upwardly inclined manner so that the user's head is above water level, the wall adjacent such first portion having a narrow, horizontal ledge below water level providing means to support substantially the entire length of the left arm of a user;

(b) a second portion on the side of said vessel opposite said first portion having a lower surface raised about chair height above said floor and contoured in a generally horizontal plane to receive a user in a reclined position with both legs extending parallel and generally horizontally and with the user's back supported in an upwardly inclined manner so that the user's head is above water level, the wall adjacent such second portion having a narrow, horizontal ledge below water level providing means to support substantially the entire length of a user's right arm;

(c) a third portion having a chair height seat surface and a reclined back support surface extending upwardly therefrom, and having, extending from the chair height portion a narrow width horizontal surface for receiving the right leg of the user and, on the opposite side, and at a higher elevation, a narrow horizontal ledge for receiving the left arm of the user;

(d) a fourth portion having a chair height seat surface and a reclined back support surface extending upwardly therefrom, and having, extending from the chair height portion, a narrow width, horizontal surface for receiving the left leg of the user and on the opposite side and at a higher elevation, a narrow width horizontal ledge for receiving the right arm of the user; and a plurality of jets by which water is injected into the interior of said vessel, the jets being positioned so that water flowing therethrough impenges on the joints of the users.

2. An enclosure for hydrothermal treatment of users according to claim 1 wherein said vessel is additionally contoured to include:

(e) at least one portion having a chair height seat surface and a generally upright back support surface extending upwardly therefrom to support a user in seated position with all portions of the user's body except the head being below water level and with the user's feet on said floor.

3. An exclosure for hydrothermal treatment of users according to claim 2 wherein said vessel is generally rectangular in plan view and wherein portion (e) includes two such chair height portions positioned one to either side of said steps, wherein said portions (c) and (d) are adjacent each other and opposite said portions (e) and wherein said portions (a) and (b) are opposite each other and on walls of said vessel perpendicular to the walls of said vessel having the other portions, providing six different user receiving portions.

* * * * *